US007381273B2

(12) United States Patent
Collins

(10) Patent No.: US 7,381,273 B2
(45) Date of Patent: Jun. 3, 2008

(54) APPARATUS AND METHOD FOR COATING MEDICAL DEVICES

(75) Inventor: Timothy Collins, Waconia, MN (US)

(73) Assignee: CuringSolutions, LLC, Minneapolis, MN (US)

( * ) Notice: Subject to any disclaimer, the term of this patent is extended or adjusted under 35 U.S.C. 154(b) by 389 days.

(21) Appl. No.: 11/079,990

(22) Filed: Mar. 15, 2005

(65) Prior Publication Data

US 2006/0210699 A1 Sep. 21, 2006

(51) Int. Cl.
*B05B 5/00* (2006.01)

(52) U.S. Cl. ..... 118/642; 118/420; 118/423

(58) Field of Classification Search ..... 118/420, 118/641, 642, 412, 423, 405; 427/2.24, 2.25
See application file for complete search history.

(56) References Cited

U.S. PATENT DOCUMENTS

| | | | | |
|---|---|---|---|---|
| 4,772,093 | A | 9/1988 | Abele et al. | |
| 5,023,187 | A | 6/1991 | Koebler et al. | |
| 5,092,264 | A * | 3/1992 | Overton et al. | 118/50.1 |
| 5,137,671 | A | 8/1992 | Conway et al. | |
| 5,545,149 | A | 8/1996 | Brin et al. | |
| 5,599,321 | A | 2/1997 | Conway et al. | |
| 6,254,921 | B1 | 7/2001 | Chappa et al. | |
| 6,406,754 | B2 | 6/2002 | Chappa et al. | |
| 2001/0026834 | A1 | 10/2001 | Chappa et al. | |
| 2003/0183972 | A1 | 10/2003 | Weber et al. | |
| 2004/0068249 | A1 | 4/2004 | Kampa et al. | |

OTHER PUBLICATIONS

Harland Medical Systems; PCX Coating Solutions, pamphlet, 2004, 2 pages.

* cited by examiner

*Primary Examiner*—Brenda A. Lamb
(74) *Attorney, Agent, or Firm*—Moore & Hansen, PLLP

(57) ABSTRACT

Apparatus and methods for coating elongated medical devices, such as guidewires and catheters, incorporating infrared (IR) heating tools for curing the coating while the medical devices are still in place on the coating apparatus. Coating and curing may be accomplished evenly in a dipping machine by utilizing IR heaters having heating heads with openings, the heating heads being mounted for the extension of such elongated medical devices through their openings so that the heating heads are in generally surrounding juxtaposition to the elongated medical devices. The voltage supply to the IR heaters may be selectively adjusted so as to match the wavelength of the generated IR heat to the energy absorbing capability of the particular coating solution being utilized for proper timed absorption of the infrared energy.

12 Claims, 3 Drawing Sheets

APPARATUS AND METHOD FOR COATING MEDICAL DEVICES

FIELD OF THE INVENTION

The invention as disclosed relates generally to the application and curing of coatings on elongated, cylindrical shaped or tubular items. In particular, the invention is directed to apparatus and processes for applying coatings to medical devices such as guidewires, catheters and pacemaker leads and for the curing of the applied coating in a very effective and efficient manner.

BACKGROUND OF THE INVENTION

Manufacturers of intravenously insertable medical devices such as guidewires, catheters and pacemaker leads traditionally apply coatings to those medical devices for various purposes. For example, friction reducing coatings are applied to the external surface of catheters and guidewires in order to enhance lubricity to facilitate the insertion of those devices within the veins and arteries of patients.

It is common practice to move the freshly coated medical devices to remotely located ovens to cure the coating by the application of heat, after the coating process has been completed. This approach to the coating and curing procedure has presented particular difficulties, including damage to the wet or uncured coated devices as they are being transported manually or robotically to curing ovens, as well as the substantial amount of processing time required to move the coated devices into and out of curing ovens. The ovens themselves represent a very substantial capital investment.

There exists a need for a coating and curing machine and process which is capable of effectively and efficiently coating medical devices and curing the coating at a single workstation by the use of a heating device which can be adjusted to accomplish the proper curing of different coating solutions.

SUMMARY OF THE INVENTION

Having in mind the foregoing shortcomings with respect to existing coating and curing systems for medical devices, I have developed machines and processes for coating elongated, wire-like medical devices such as guidewires, catheters and pacemaker leads, utilizing infrared ("IR") heating tools. The wavelength of the infrared heat generated during the curing process may be controlled by varying the voltage supplied to the heating tool. This permits matching the infrared wavelength of the heat source to the IR absorption rate of the particular coating solution being utilized to accomplish optimum drying and curing efficiency.

The infrared heating tools preferably take the form of nickel-chromium heating elements encapsulated in quartz and configured to define an opening within which an elongated medical device may be removably received. The IR heating elements are mounted in a housing which advantageously contains a variable frequency voltage regulator.

In a preferred embodiment for dip coating applications, an array of the heating tools is mounted on a dip coating machine of the known type in which guidewires or catheters are vertically supported for reciprocal vertical movement, downwardly into receiving coils where they are coated, and upwardly through guide funnels. The wire-like medical devices are coated by dipping them in a curing solution contained within the coil of receiving tubing for each guidewire. The heating tools are positioned to substantially encircle the guidewires, separately, so that as the guidewires are elevated after the coating step, the coating is cured by time-controlled upward movement past the IR heating elements.

These and other objects and advantages of the invention will become readily apparent as the following description is read in conjunction with the accompanying drawings wherein like reference numerals have been used to designate like elements throughout the several views.

DESCRIPTION OF THE PREFERRED EMBODIMENTS

Figure 1:
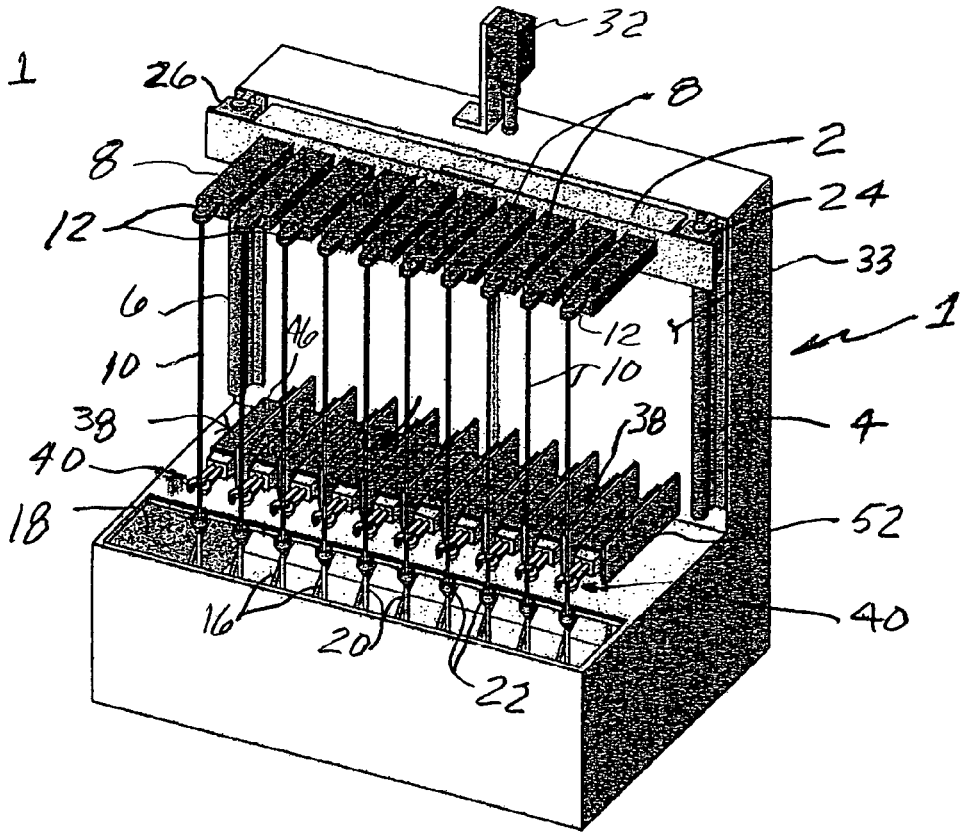
FIG. 1 is a front perspective view of the coating and curing machine of this invention, showing a carrier bar for elongated medical devices in its raised position.
Figure 2:
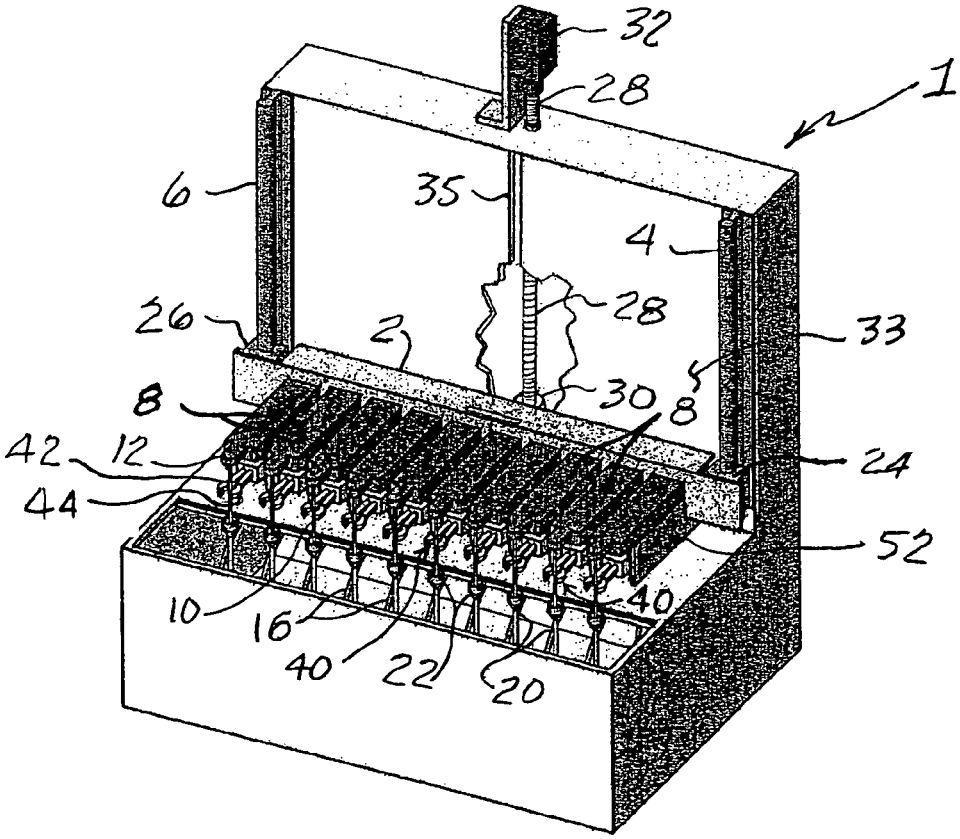
FIG. 2 is a front perspective view of the coating and curing machine of FIG. 1 showing the carrier bar in its lowered, coating position.
Figure 3:
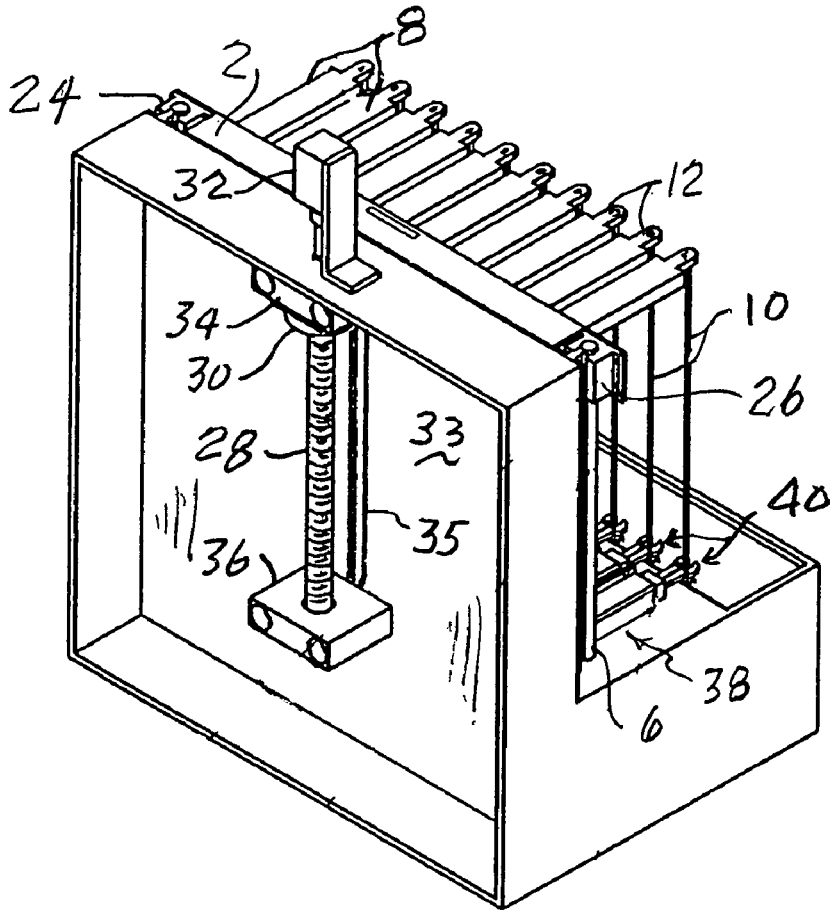
FIG. 3 is a rear perspective view of the coating and curing machine.
Figure 4:
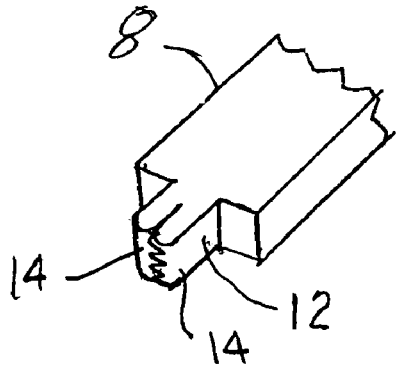
FIG. 4 is a fragmentary, perspective view of a clip device utilized to secure elongated medical devices in place for coating on the machine.

Referring now to the drawings, there is shown in FIGS. 1-3 the improved coating and curing machine of this invention, designated by reference numeral 1. The machine is of the dip coating type utilized for coating elongated medical devices such as guidewires, catheters and pacemaker leads. For that purpose, a mounting member in the form of a vertically movable carrier bar 2 is slidably supported for vertical movement on a pair of vertically extending guide rails 4, 6. Attached to the carrier bar 2 are a plurality of arms 8 serving as support devices for the releasable attachment of a plurality of elongated medical devices 10. For that purpose, attachment heads 12 are provided on the outer ends of arms 8. One suitable form of attachment head is shown in FIG. 4 and comprises a clip having a pair of resilient spring jaws 14, which may be urged apart for the insertion of an elongated medical device, and which then bias inwardly to provide a friction clamping action. For that purpose, attachment heads 12 may be made out of suitable rubber or plastic material. Alternatively, various forms of spring clips or collets may be used to releasably secure in place the upper ends of elongated medical devices.

In FIGS. 1 and 2, a plurality of elongated medical devices, such as guidewires or catheters 14, are shown secured in place on support arms 8 in a generally vertical orientation on coating and curing machine 1. It is to be noted that the coating and curing machine of this invention is adapted to coat wire-like medical devices of any kind, including guidewires, catheters and pacemaker leads which are flexible enough to permit their intravenous insertion in patients.

Figure 5:
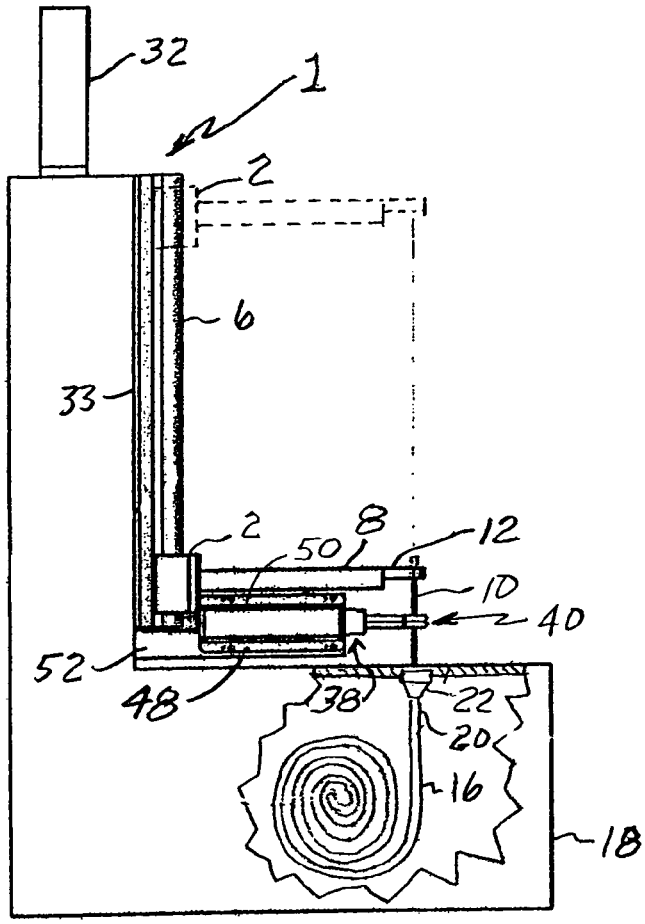
FIG. 5 is a side elevation view of the coating and curing machine, partially in section, with the carrier bar in its lowered position.

For coating purposes in the dip type of coating machine disclosed, one or more coating tubes 16 are provided in the lower tank portion 18 of the machine 1, as shown in FIGS. 2 and 5. Tubes 16 may be configured as coils as shown in FIG. 5, or otherwise wound as desired, for example, in a helical configuration. Tubing 16 is flexible, to accommodate the insertion of flexible, wire-like medical devices 10. Tubing 16 can be made from suitable plastic material. The innermost ends of coating tube 16 are closed, with the upper, receiving ends 20 being open for the reception of wire-like medical devices 10. At their upper ends, coating tubes 16 are preferably provided with funnels or receiving cups 22. Tubes 16 are filled through funnels 22 with a desired coating solution. In practice, a particular coating solution will be selected for the particular material and type of medical device being coated. For example, to enhance the lubricity of guidewires and catheters, a coating solution suitable for that purpose will be utilized. Typically, the coating solution may have a silicone base with a solvent added. The solvent serves to create adhesion to the wire-like medical device during a curing process, and the solvent evaporates during curing. The tubes 16 will normally be filled with the coating solution to a level near the top of funnels 22.

As may best be understood by reference to FIGS. 2 and 3, a drive mechanism is provided for moving carrier bar 2 upwardly and downwardly in sliding movement on guide rails 4 and 6, carrier bar 2 having bearing blocks 24 and 26 mounted at its opposite ends for that purpose. The drive mechanism may preferably comprise a drive screw 28 on which a follower nut 30 is threadedly engaged. A D.C. drive motor 32 may be mounted as shown at the top of the machine in coupling engagement with screw 28. As shown in FIG. 3, bearings 34 and 36 rotatably support drive screw 28. Carrier bar 2 is attached to follower nut 30 by a mounting plate or bracket (not shown). The front panel wall 33 of the machine housing is provided with a vertical slot 35 as shown in FIG. 2 to permit the passage and reciprocal vertical movement of the nut attachment bracket with carrier bar 2. It will be appreciated that by the use of a reversible drive motor 32, nut 30 may be made to move upwardly and downwardly on screw 28, and thus to translate carrier bar 2 in the desired vertical direction for coating and curing.

The heating and curing of a wet coating applied to wire-like medical devices 10 is advantageously carried out on the same machine 1 in which the coating operation takes place. This is accomplished by the use of one or more infrared (IR) heating tools 38 positioned as shown in FIGS. 1, 2 and 5 between the movable mounting member or carrier bar 2 and the coating tubes 16. Preferably, heating tools 38 are positioned at a predetermined, common vertical location, in a generally horizontal plane, so as to locate their heating heads 40 in close proximity to the receiving ends 20 of coating tubes 16. As shown in FIGS. 2 and 5, heating heads 40 are located directly above funnels 22 in proximity thereto.

Figure 6:
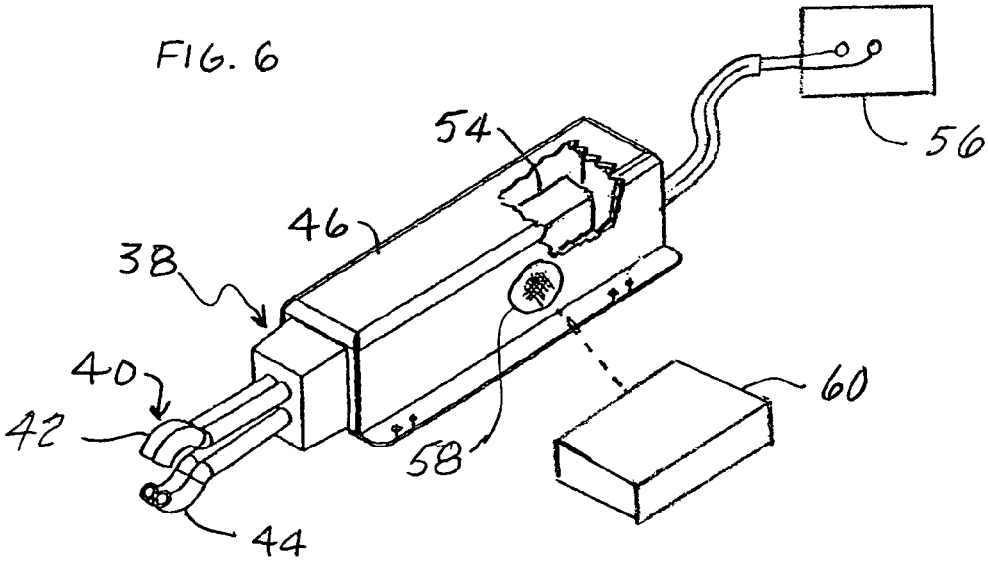
FIG. 6 is a perspective view of one of the infrared heating tools utilized to cure the coating.

As is shown most clearly in FIG. 6, the heating tool 38 is preferably contained within a housing 46 having mounting flanges 48 and 50. Both of those flanges are shown in FIG. 5. In the embodiment shown, heating tools 38 are secured in a laterally spaced, fixed vertical position in the arrangement shown in FIGS. 1, 2 and 5. The flanges 48, 50 of each heating tool are attached by fasteners or adhesive to a vertical bracket plate 52, with the rear end of bracket plates 52 being secured by welding or otherwise to the front wall panel 33 of the coating and curing machine. Mounting brackets 52 are notched to provide an L-shape, so that the lower end of the mounting brackets can pass under carrier bar 2 when it is in its lowermost position as shown in FIGS. 2 and 5. It is to be understood that rather than firing the heating tools 38, they can be mounted for vertical movement so as to achieve the desired relative movement between the coated wire-like devices and the heating heads to accomplish heating and curing of the applied coating.

Referring again to FIG. 6, it will be seen that the heating tool 38 is provided with a pair of heating elements 40, 42. Those heating elements are preferably of the type comprising nickel chromium wire heating elements encased in quartz tubes, such heating elements being commercially available from Eraser International Ltd. of Andover, England. The heating elements 40 and 42 are preferably arcuate shaped as shown to define an opening therebetween into which and through which a wire-like medical device may be inserted. The split ring configuration of the heating elements shown in FIG. 6 permits the wire-like medical devices to be inserted between the split-apart ends of the heating elements and into the opening between the two heating elements. As shown in FIGS. 1 and 2, one or more of the wire-like medical devices 10 may be removably attached at their upper ends to attachment heads 12 and positioned within the apertured heating elements 42, 44 of heating heads 40. In the mounting of the wire-like devices, their lower ends are centered within funnels 22 of coating tubes 16.

In the course of a coating and curing operation, one or more of the wire-like medical devices 10 is first removably secured as described to the support arms 8. At this time, carrier bar 2 will be at its elevated position as shown in FIG. 1. Each of the coating tubes 16 will have been filled to near the top of funnels 22 with a desired coating solution appropriate for the particular devices being coated. Motor 32 of the drive mechanism is then actuated to rotate screw 28 in such a direction that follower nut 30 translates downwardly, and carries bar 2 with it. In this way, the wire-like devices such as catheters or guidewires are lowered into coating tubes 16. After the medical devices have remained in the coating solution within the tubes 16 for a predetermined period of time, the heating tools 38 are electrically actuated so that the heating elements 42, 44 generate IR heat energy. Drive motor 32 is then again actuated in a reverse direction to raise carrier bar 2 and to lift the coated medical devices 10 vertically and withdraw them from the coating tubes 16. The speed of drive motor 32 is closely controlled to provide a predetermined extraction rate of the coated medical devices. That rate will be very slow, such as on the order of two inches per second. The extraction rate of the medical devices, in combination with the time during which they are left in the coating solution within tubes 16 controls the wall thickness of the coating applied. A complete, even coating is provided over the entire outer surface of the wire-like medical devices.

The centering of the wire-like devices within the apertured heating heads 40 ensures the even application of infrared heat around the entire peripheral surface of those devices so as to get even heating and curing of the coating. As the medical devices pass through the heating heads, between arcuate heating elements 42 and 44, the heating and curing of the applied coating is carried out, with that process being completed, by the timed elevation of carrier bar 2, when that bar reaches the top extremity of its travel path as shown in FIG. 1.

The timing interval for dip coating within the coating tubes 16, as well as the sequential, timed actuation of the IR heaters and the lift motor may be controlled by a programmable timer. Heating elements 42, 44 may be energized a few seconds before motor 32 or substantially simultaneously therewith, at the beginning of the medical device extraction and lift cycle. Alternatively, actuation of the drive motor 32 on the lowering and raising cycles, and of the heating tools may be accomplished manually.

As an advantageous feature, a voltage regulator is provided within housing 46 of the heating tool 38. Such a voltage regulator is indicated by reference numeral 54 in FIG. 6. Preferably, the voltage regulator is of the adjustable frequency type. The voltage regulators of each of the heating tools 38 are connected to a common power supply or bus bar 56, as indicated schematically in FIG. 6. A programmable, frequency modulated voltage regulator incorporating a microprocessor may be utilized. For that purpose, a signal receiving window 58 is provided in the sidewall of housing 46 to receive signals from a remote computer or CPU. Such a computer may be utilized to initially program the voltage regulator within a frequency range to determine the parameters of the infrared heat energy generated. Also, the remote computer may then be utilized, on site, to send a signal adjusting the frequency, and thus the voltage output of voltage regulator 54, so as to generate infrared energy at a desired frequency. This is particularly beneficial because it permits adjusting the infrared heat generated by the heating tools to a particular wavelength matching or compatible with the infrared absorption rate of the particular coating solution applied. In this way, manufacturers of coated medical devices may establish effective quality control of the heating and curing process so as to ensure even and complete heating and curing of the applied coating.

After the coating and curing process has been completed on machine 1, the coated and cure-dried medical devices may be quickly and easily removed by releasing attachment heads 12. Efficiencies of coating and curing elongated devices are achieved by incorporating the heating and curing tools in the same machine within which the coating operation takes place.

It will be understood by those skilled in the art that the coating and curing apparatus, and related process, disclosed herein may be modified in various ways without departing from the spirit and scope of the invention as defined by the following claims.

What is claimed is:

1. In an apparatus of the dip coating type for coating elongated medical devices such as guidewires and catheters, the apparatus having a vertically movable mounting member to which one or more such medical devices may be releasably attached, a drive mechanism for raising and lowering the mounting member, and at least one coating tube filled with a desired coating solution and having a receiving end positioned below the mounting member to receive and coat each such medical device, the improvement comprising:

One or more infrared heating tools mounted on the dip coating apparatus between the movable mounting member and the coating tubes, each heating tool having a heating head containing electrically energizable heating elements configured to define an opening constructed and arranged to movably receive an elongated medical device therethrough, whereby the drive mechanism may be actuated to lower the elongated medical devices into the coating tubes for coating and subsequently to raise the medical devices upwardly through the energized heating head openings to cure the coating.

2. The improved dip coating and curing apparatus of claim 1 wherein:

a plurality of said heating tools are positioned in a horizontal plane, at laterally spaced locations to separately receive within their heating head openings vertically extending, elongated medical devices releasably attached at their upper ends to the mounting member; and a plurality of coating tubes filled with a coating solution and having receiving ends, with each tube having its receiving end positioned below the heating head of one of the heating tools in substantially vertical alignment therewith.

3. The improved dip coating and curing apparatus of claim 2 wherein:

the heating tools are affixed at a predetermined, common vertical location to position their heating heads in close proximity to the receiving ends of the coating tubes in vertical alignment therewith.

4. The improved dip coating and curing apparatus of claim 2 wherein:

the heating heads of the heating tools are generally ring-shaped to define said openings.

5. The improved dip coating and curing apparatus of claim 1 wherein:

each of the heating tools incorporates a voltage regulator connected to its heating elements, whereby the wavelength of the infrared heat generated by the heating tools may be selectively adjusted by regulating the voltage so as to match the wavelength of the infrared heat to the infrared absorption rate of the particular coating solution being utilized.

6. The improved dip coating and curing apparatus of claim 5 wherein:

the voltage regulators are frequency adjustable for control of the voltage supply to the heating elements.

7. A machine for applying a coating to elongated medical devices and curing the coating on the same machine comprising:

a plurality of support devices so mounted as to releasably support a plurality of elongated medical devices in a generally vertical orientation;

a plurality of coating devices arranged in coating applying juxtaposition to the support devices as to apply a coating to each of such medical devices as supported on the support devices;

a plurality of infrared heating tools disposed in a horizontal plane, with each of the heating tools having an electrically energizable heating head defining an opening located in vertical alignment with one of the support devices and constructed and arranged to embrace a medical device extended therethrough, whereby a plurality of medical devices may be releasably mounted on the support devices and extended through the openings in the heating heads; and a drive mechanism constructed and arranged to provide relative vertical movement between the medical devices and the infrared heating heads, whereby the heating heads may be energized to cure a coating applied to each of a plurality of medical devices by the actuation of the drive mechanism to generate relative vertical movement between the medical devices and the heating heads.

8. The coating and curing machine of claim 7 wherein:

the coating devices comprise tubes containing a desired coating solution.

9. The coating and curing machine of claim 8 wherein:

each of the coating tubes has an open receiving end in generally vertical alignment with the opening in the heating head of one of the heating tools, whereby the drive mechanism may be actuated to lower elongated medical devices into the coating tubes for coating and to raise the medical devices for passage through the energized heating heads for the infrared heating and curing of the coating.

10. The coating and curing machine of claim 9 wherein:

the heating heads are positioned in generally vertical alignment with and in proximity to the receiving ends of the coating tubes.

11. The coating and curing machine of claim 7 wherein:

each of the heating tools comprises a regulator electrically connected to its heating head, whereby the heating heads may be adjusted so as to generate infrared heat with a desired wavelength compatible to the infrared absorption rate of the particular coating being utilized.

12. The coating and curing machine of claim 11 wherein:

the regulators are frequency adjustable.

* * * * *